US008968827B2

(12) United States Patent
Trowbridge et al.

(10) Patent No.: US 8,968,827 B2
(45) Date of Patent: Mar. 3, 2015

(54) METHODS OF FORMING BORON NITRIDE

(75) Inventors: Tammy L. Trowbridge, Idaho Falls, ID (US); Alan K. Wertsching, Idaho Falls, ID (US); Patrick J. Pinhero, Columbia, MO (US); David L. Crandall, Idaho Falls, ID (US)

(73) Assignee: U.S. Department of Energy, Washington, DC (US)

( * ) Notice: Subject to any disclaimer, the term of this patent is extended or adjusted under 35 U.S.C. 154(b) by 1838 days.

(21) Appl. No.: 12/060,711

(22) Filed: Apr. 1, 2008

(65) Prior Publication Data

US 2011/0293955 A1 Dec. 1, 2011

(51) Int. Cl.

| | |
|---|---|
| ***B05D 5/00*** | (2006.01) |
| ***C23C 26/00*** | (2006.01) |
| ***C23C 30/00*** | (2006.01) |
| ***F41A 21/02*** | (2006.01) |
| ***F41A 21/04*** | (2006.01) |
| ***F41A 21/12*** | (2006.01) |
| ***F41A 29/04*** | (2006.01) |
| ***F42B 12/80*** | (2006.01) |
| ***F42B 12/82*** | (2006.01) |

(52) U.S. Cl.

CPC ..... *C23C 26/00* (2013.01); *C23C 30/00* (2013.01); *F41A 21/02* (2013.01); *F41A 21/04* (2013.01); *F41A 21/12* (2013.01); *F41A 29/04* (2013.01); *F42B 12/80* (2013.01); *F42B 12/82* (2013.01)

USPC ..... 427/226

(58) Field of Classification Search

USPC ..... 427/226

See application file for complete search history.

(56) References Cited

U.S. PATENT DOCUMENTS

| | | | | |
|---|---|---|---|---|
| 4,150,097 | A | | 4/1979 | Hough et al. |
| 4,545,968 | A | * | 10/1985 | Hirano et al. ..... 423/290 |
| 4,731,303 | A | * | 3/1988 | Hirano et al. ..... 428/700 |
| 5,079,038 | A | * | 1/1992 | Rye ..... 427/248.1 |
| 5,175,020 | A | | 12/1992 | Doellein et al. |
| 5,188,757 | A | * | 2/1993 | Paine et al. ..... 252/183.11 |
| 5,378,499 | A | | 1/1995 | Martin et al. |
| 5,408,964 | A | * | 4/1995 | Rao ..... 123/193.2 |

(Continued)

OTHER PUBLICATIONS

Coad et al., "Experience with boron-carbide coated target tiles in JET," J. of Nuclear materials 200 (1993) 389-394.

(Continued)

*Primary Examiner* — Robert Vetere

(74) *Attorney, Agent, or Firm* — Michael J. Dobbs; Daniel D. Park; John T. Lucas

(57) ABSTRACT

A method of forming a boron nitride. The method comprises contacting a metal article with a monomeric boron-nitrogen compound and converting the monomeric boron-nitrogen compound to a boron nitride. The boron nitride is formed on the same or a different metal article. The monomeric boron-nitrogen compound is borazine, cycloborazane, trimethylcycloborazane, polyborazylene, B-vinylborazine, poly(B-vinylborazine), or combinations thereof. The monomeric boron-nitrogen compound is polymerized to form the boron nitride by exposure to a temperature greater than approximately 100° C. The boron nitride is amorphous boron nitride, hexagonal boron nitride, rhombohedral boron nitride, turbostratic boron nitride, wurzite boron nitride, combinations thereof, or boron nitride and carbon. A method of conditioning a ballistic weapon and a metal article coated with the monomeric boron-nitrogen compound are also disclosed.

15 Claims, 2 Drawing Sheets

(56) References Cited

U.S. PATENT DOCUMENTS

| | | | | |
|---|---|---|---|---|
| 5,502,142 | A * | 3/1996 | Sneddon et al. | 528/7 |
| 5,518,780 | A * | 5/1996 | Tamor et al. | 427/573 |
| 6,025,454 | A | 2/2000 | Sneddon et al. | |
| 6,090,756 | A | 7/2000 | Brown | |
| 6,277,348 | B1 * | 8/2001 | Pujol et al. | 423/290 |
| 6,576,598 | B2 * | 6/2003 | Brown | 508/118 |
| 7,197,986 | B1 | 4/2007 | Calkins | |
| 2003/0078170 | A1 | 4/2003 | Brown | |

OTHER PUBLICATIONS

Dahl et al., "Studies of Boron-Nitrogen compounds. III. Preparation and Properties of Hexahydroborazole, B3N3H12," 1960, Journal of the American Chemical Society, 83:3032-3034.

Gaines et al., "Studies of Boron-Nitrogen Compounds. V. Two Isomers of 1,3,5-Trimethylcycloborazane," 1963, Journal of the American Chemical Society, 85:395-397.

Laubengayer et al., "The Formation and Behavior of Polycyclic Borazines," Boron-Nitrogen Chemistry, Advances in Chemistry Series #42. 1964, pp. 281-289.

Martin et al., "Ab Initio Study of the Isoelectronic Molecules BCN, BNC, and C3 Including Anharmonicity," J Phys Chem, 1994, 98:6105-6109.

Noth et al., "Contribution to the Chemistry of Boron, 241[1] Improved Synthesis of 2,4,6-Trichloroborazine," Verlag der Zeitschrift fur Naturforschung, 1997, pp. 1345-1348.

Wideman et al., "Borazine, polyborazylene, B-vinylborazine and poly(B-vinylborazine)," Main Group and Transition Metal Cluster Compounds, (1998) pp. 232-242.

Wideman et al., "Convenient Procedures for the Laboratory Preparation of Borazine," Inorg Chem, 1995, 34:1002-1003.

PCT International Search Report and Written Opinion of the International Searching Authority for PCT/US09/38776, dated Sep. 24, 2009, 7 pages.

* cited by examiner

METHODS OF FORMING BORON NITRIDE

STATEMENT REGARDING FEDERALLY SPONSORED RESEARCH OR DEVELOPMENT

This invention was made with government support under Contract No. DE-AC07-05ID14517 awarded by the United States Department of Energy. The government has certain rights in the invention.

TECHNICAL FIELD

The invention relates to a coating for a metal article. More specifically, embodiments of the invention relate to methods of forming a boron nitride from a monomeric boron-nitrogen compound, a method of conditioning a ballistic weapon, and a metal article including a coating of the monomeric boron-nitrogen compound thereon.

BACKGROUND

Designers of ballistic weapons have improved designs in propellants, projectile chambers, and muzzles to improve speed, distance, and accuracy of a projectile fired from the ballistic weapon. However, with these improvements, temperature, friction, and inertia generated within the ballistic weapon during firing have become problems. Solving these problems has been difficult since the problems have interrelated consequences. At best, a compromise between these problems has been achieved.

As the projectile is fired from the ballistic weapon, particles of the projectile are deposited on the barrel of the ballistic weapon due to friction, which fouls the barrel. A majority of projectiles are formed from lead or a leaded alloy, which are suitable for low speed (less than approximately 1000 ft/sec), black powder-type ballistic weapons. However, even in low speed ballistic weapons, frequent cleaning is needed to remove the deposits. Fouling and failure of rifle barrels is also problematic, especially in military use where the integrity of the barrel is pushed to its limits. It is estimated that during firing of a rifle, the temperature within the barrel exceeds 3000° C. and the pressure exceeds 50,000 psi. These temperatures and pressures create cracking, wear, and erosion within the barrel, which greatly reduces its lifetime. As the barrel wears, the range and accuracy of the fired projectile are decreased. In addition, wear in the barrel causes fuse malfunctions, rifling stripping due to torsional impulse, propellant gas blow-by, and excessive muzzle flash. Therefore, the worn barrel must be replaced periodically. It is estimated that with military small firearms alone, approximately 52,000 barrels are replaced each month.

Several approaches have been proposed to increase the lifetime of the ballistic weapon. One solution has been to encase a leaded bullet within a copper jacket, increasing the melting temperature of the outer layer of the bullet and decreasing deposition of metal within the barrel. However, with high velocity projectiles, the temperature within the barrel approaches the melting point of copper. In these cases, molybdenum disulfide ("$MoS_2$") coatings are used to protect the copper jacket. However, $MoS_2$ has a large particle size, typically from 10 μm to 35 μm, and does not embed into cracks in the barrel to create a lubricating surface. In addition, $MoS_2$ decomposes above a temperature of 315° C. in an oxidizing environment. Since the barrel temperature for low speed rifles easily exceeds 327° C., decomposition of the $MoS_2$ occurs, producing $MoO_2$, MoC, and Mo.

Hexagonal boron nitride ("h-BN") has also been used as a ballistic conditioner. As disclosed in U.S. Pat. No. 6,576,598 to Brown, a coating of h-BN, graphite, tungsten disulfide, antimony trioxide, mica, talc, or mixtures thereof is applied to a firearm, firearm component, firearm ammunition, or ammunition element. The h-BN is purchased from a supplier. U.S. Pat. No. 7,197,986 to Calkins discloses applying a dry ceramic lubricant to a gun barrel or a bullet. The dry ceramic lubricant is an h-BN powder. In addition, cubic boron nitride ("c-BN"), which is an abrasive material, has been used to pressure lap gun barrels. As disclosed in U.S. Pat. No. 5,378,499 to Martin et al., c-BN is applied to a bullet. The coated bullet is fired through a gun barrel to remove dimensional variations and roughness in the bore of the gun.

While h-BN coated projectiles or coated barrels have been proposed to increase the lifetime of the barrel, the h-BN has a relatively large particle size and does not penetrate into cracks in the barrel. As such, the h-BN coating provides, at best, lubrication as the projectile exits the barrel. Therefore, it would be desirable to produce a coating that provides lubrication and metal healing properties to the barrel or other metal article.

SUMMARY OF THE INVENTION

In one embodiment, the present invention comprises a method of forming a boron nitride. The method comprises contacting a metal article with a monomeric boron-nitrogen compound and converting the monomeric boron-nitrogen compound to a boron nitride.

In another embodiment, the present invention comprises a method of forming a boron nitride comprising contacting a metal article with a boron-nitrogen compound not including boron nitride and heating the boron-nitrogen compound to produce a boron nitride.

In another embodiment, the present invention comprises a method of forming a boron nitride comprising applying a monomeric boron-nitrogen compound to a metal article and polymerizing the monomeric boron-nitrogen compound on the same or a different metal article.

In another embodiment, the present invention comprises a method of conditioning a ballistic weapon comprising coating at least one of a projectile and a surface of a ballistic weapon with a monomeric boron-nitrogen compound and forming a boron nitride on the surface of the ballistic weapon.

In another embodiment, the present invention comprises a metal article comprising a coating of a monomeric boron-nitrogen compound on a metal article.

BRIEF DESCRIPTION OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

DETAILED DESCRIPTION

Figure 1:
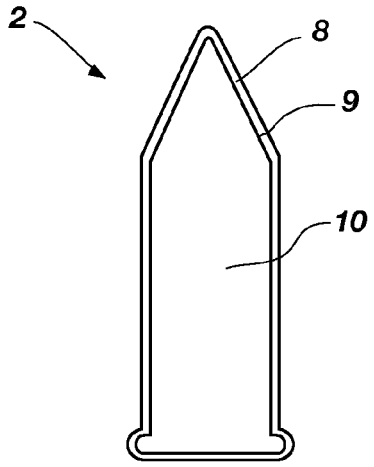
FIG. 1 is a cross-sectional view of a projectile coated with a monomeric boron-nitrogen compound according to an embodiment of the invention.

A method for forming a boron nitride from a starting material containing boron and nitrogen is disclosed. As used herein, the term "boron nitride" means and includes a compound containing boron and nitrogen, such as boron nitride or boron nitride and carbon. The starting material is a monomer and is referred to herein as a "monomeric boron-nitrogen compound." The method includes contacting a metal article with a monomeric boron-nitrogen compound and converting the monomeric boron-nitrogen compound to a boron nitride. As used herein, the term "metal article" means and includes an article having at least one surface or at least one component formed from metal. The boron nitride may be formed on the same metal article upon which the monomeric boron-nitrogen compound is contacted or applied. As such, the boron nitride may be formed in-situ on the metal article. Alternatively, the boron nitride may form on a different metal article, such as a metal article that comes into contact with the metal article upon which the monomeric boron-nitrogen compound is applied. The monomeric boron-nitrogen compound may be applied to the metal article and subjected to process conditions sufficient to produce boron nitride on the same metal article or the different metal article. The process conditions may include temperature conditions, or temperature conditions and at least one of pressure conditions and force conditions, to which the metal article is exposed. The process conditions sufficient to produce boron nitride may be generated during use and operation of the metal article(s).

As described below, the metal article may be a ballistic weapon, a projectile fired from the ballistic weapon, or an internal combustion engine. However, the metal article may be another metal article in which the use and operation thereof provides the process conditions sufficient to produce boron nitride from the monomeric boron-nitrogen compound.

The monomeric boron-nitrogen compound may be an inorganic compound, such as a compound including boron, nitrogen, hydrogen, and, optionally, carbon. By way of non-limiting example, the monomeric boron-nitrogen compound may be borazine ("$B_3N_3H_6$"), cycloborazane ("$B_3H_6N_3H_6$"), trimethylcycloborazane, polyborazylene ("$(B_3N_3H_{\sim 4})_x$"), B-vinylborazine ("$H_3C_2B_3N_3H_5$"), poly(B-vinylborazine), or combinations thereof. The monomeric boron-nitrogen compound may also be a derivative of one of the above-mentioned compounds, such as an alkylated, arylated, or hydroxylated derivative. The monomeric boron-nitrogen compound may be synthesized by conventional techniques. The monomeric boron-nitrogen compound may have an approximate molecular size of greater than or equal to approximately 10 Å.

In one embodiment, the monomeric boron-nitrogen compound is borazine, which is a liquid at room temperature. Borazine is isoelectronic to benzene and may be synthesized by conventional techniques. By way of non-limiting example, borazine may be synthesized from ammonium sulfate and sodium borohydride, as described in Wideman et al., "Convenient Procedures for the Laboratory Preparation of Borazine," Inorg. Chem. 34(4):1002-1003 (1995). Alternatively, the borazine may be produced from 2,4,6-trichloroborazine and sodium borohydride, as described in Noth et al., "Contribution to the Chemistry of Boron, 241{1} Improved Synthesis of 2,4,6-Trichloroborazine," Z. Naturforsch. 52b:1345-1348 (1997). The borazine may also be produced by pyrolysis of ammonia borane, as described in U.S. Pat. No. 4,150,097 to Hough et al. In another embodiment, the monomeric boron-nitrogen compound is cycloborazane, which is a white solid. Cycloborazane is isoelectronic to cyclohexane and may be synthesized by conventional techniques. By way of non-limiting example, the cycloborazane may be synthesized from borazine and sodium borohydride, as described in Dahl et al., "Studies of Monomeric boron-nitrogen compounds. III Preparation and Properties of Hexahydroborazole, $B_3N_3H_{12}$," JACS 83(14):3032-3034 (1961).

The monomeric boron-nitrogen compound may be applied to the metal article by a conventional coating technique, such as by plasma spray, dip coating, aerosol spray, airless spraying, air-assisted spraying, air brush, spray pumper, wicking or wiping, brushing as with a paint brush, immersion, quenching, tumbling, auguring, or mechanical embossing. The monomeric boron-nitrogen compound may be at least partially soluble in a solvent, such as an organic solvent or water. As such, the monomeric boron-nitrogen compound may be dissolved or suspended in the organic solvent or water, forming a solution or suspension of the monomeric boron-nitrogen compound. For convenience, the term "monomeric boron-nitrogen compound solution" is used herein to refer to a solution or suspension of the monomeric boron-nitrogen compound. The monomeric boron-nitrogen compound solution may function in the monomeric boron-nitrogen compound solution as a binder. The monomeric boron-nitrogen compound solution may also include more than one monomeric boron-nitrogen compound. The monomeric boron-nitrogen compound may account for from approximately 1% by weight to approximately 50% by weight of a total weight of the monomeric boron-nitrogen compound solution based on the weight of the organic solvent or water. However, depending on the intended use of the monomeric boron-nitrogen compound solution, the amount of the monomeric boron-nitrogen compound may be present in the monomeric boron-nitrogen compound solution at a greater amount. To improve solubility or coating properties, the monomeric boron-nitrogen compound solution may, optionally, include at least one surfactant, at least one additional polymeric material, or other additives. The surfactant, polymeric material, or other additive, if present, may be selected based on the desired properties of the monomeric boron-nitrogen compound solution and is not limited to any particular material.

The organic solvent of the monomeric boron-nitrogen compound solution may be a single organic solvent or a mixture of organic solvents. The organic solvent may be a hydrocarbon solvent including, but not limited to, a $C_1$-$C_{10}$ alkane, toluene, or xylene; an alcohol including, but not limited to, ethanol, n-propanol, i-propanol, or butanol; an ester including, but not limited to, ethyl acetate, butyl acetate, dibutyl phthalate, or cellusolve acetate; a ketone including, but not limited to, acetone or methyl isobutyl ketone; or an alkyd resin. In addition, a mixture of two or more of these organic solvents or a mixture of one or more organic solvents with water may be used in the monomeric boron-nitrogen compound solution. By way of non-limiting example, the organic solvent may be XIM® 900 Clear Coat, which is an acrylic modified alkyd resin commercially available from XIM® Products, Inc. (Westlake, Ohio). The organic solvent with the dissolved or suspended monomeric boron-nitrogen compound may also function as a binder to adhere the monomeric boron-nitrogen compound to the metal article.

When the monomeric boron-nitrogen compound solution is applied to the metal article, the monomeric boron-nitrogen compound may adhere to the metal article, forming a coating that includes substantially pure monomeric boron-nitrogen compound. The coated metal article may be dried, such as by evaporating the water or organic solvent at ambient conditions or by exposing the coated metal article to a heat treatment. When dried, the coating of the monomeric boron-nitrogen compound on the metal article may provide a minimal change to the internal or external diameter of the metal article. The coating of the monomeric boron-nitrogen compound may be present on an internal surface or an external surface of the metal article.

When the coated metal article is subjected to a temperature of greater than approximately 100° C., the monomeric boron-nitrogen compound may be polymerized to a film of a boron nitride. Boron nitride is an inorganic, polycyclic polymer and occurs in a variety of polymorphs, some of which exhibit lubrication and metal healing properties. By way of non-limiting example, the boron nitride may be amorphous BN ("a-BN"), h-BN, rhombohedral BN ("r-BN"), turbostratic BN ("t-BN"), wurzite BN ("w-BN"), or combinations thereof. If the monomeric boron-nitrogen compound includes carbon, the film produced by the polymerization may include boron nitride and carbon ("BNC"). In one embodiment, a temperature of greater than approximately 100° C. is generated during use and operation of the metal article. If the temperature of the coated metal article is greater than approximately 900° C. and the coated metal article is exposed to oxygen, a portion of the boron nitride produced may decompose, producing boric acid, borax, and $NO_x$ gases and residues. However, these by-products are non-destructive and do not corrode or otherwise impact the film of boron nitride.

By way of non-limiting example, the temperature of greater than approximately 100° C. may be generated during firing of a coated projectile from a ballistic weapon, during firing of a projectile from a ballistic weapon having a coated, internal surface, or during firing of a coated projectile from a ballistic weapon having a coated, internal surface. The pressure and/or force conditions generated during use and operation of the metal article may also contribute to converting the monomeric boron-nitrogen compound into boron nitride. In addition, the pressure and/or force conditions may cause the boron nitride to embed into cracks or other openings in the metal article. As the monomeric boron-nitrogen compound polymerizes into boron nitride, the monomeric boron-nitrogen compound may react with and form nitrides in the cracks of the metal article. Since the boron nitride is formed from monomers (i.e., the monomeric boron-nitrogen compound), the boron nitride may have a small, average particle size, such as an average particle size of from greater than or equal to approximately 10 Å to less than approximately 5 μm. As such, the boron nitride may at least partially fill the size of cracks present on the surface of the metal article. The small particle size may enable the boron nitride to penetrate into or form within the cracks in the metal article.

The film of boron nitride may provide lubrication to the metal article, in addition to providing a protective coating or chemical barrier that prevents corrosion or oxidation, such as that caused by exposure to water, corrosive by-products, environmental acids, or solvents. The film may also provide metal healing properties by penetrating into cracks in the metal article. The film may also function as an insulating layer to reduce thermal shock.

In one embodiment, the coated metal article is at least one of a coated projectile and a coated ballistic weapon. The monomeric boron-nitrogen compound may be applied to the projectile, at least one surface of the ballistic weapon, or both, forming at least one of a coated projectile 2 (FIG. 1) and a coated surface 4 of a ballistic weapon 6 (FIGS. 2A and 2B). The drawings presented herein are not meant to be actual views of any particular projectile or ballistic weapon, but are merely idealized representations which are employed to describe the present invention. Additionally, elements common between figures may retain the same numerical designation.

Figure 2A:
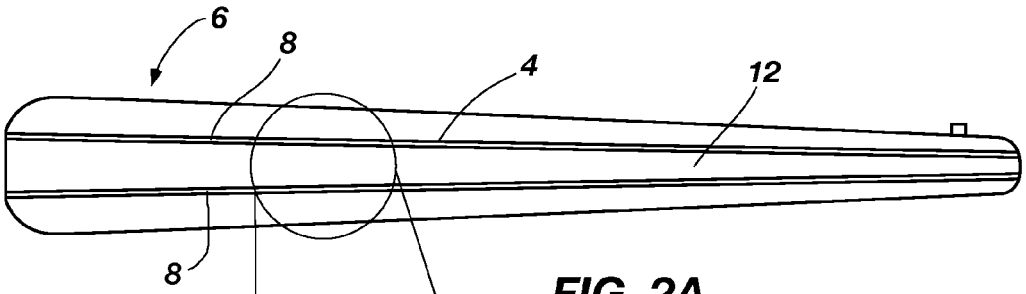
FIGS. 2A and 2B are cross-sectional views of a ballistic weapon coated with a monomeric boron-nitrogen compound according to an embodiment of the invention.
Figure 2B:
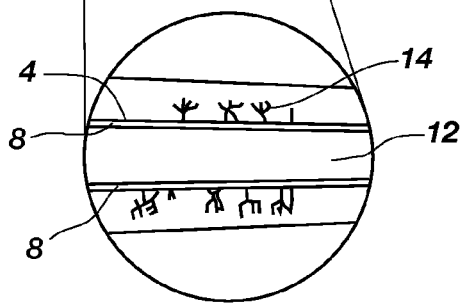

A coating 8 may partially cover or partially encapsulate an external surface 9 of projectile 10, or may substantially cover or substantially encapsulate the external surface 9 of the projectile 10, the latter of which is illustrated in FIG. 1. The external surface 9 of the projectile 10 may be a metal surface. The projectile 10 may be a small- or large-caliber bullet or large artillery projectile including, but not limited to, a shotgun shell, a shotgun wad, a bullet, a bullet casing, an artillery shell, a rifle shell, a sabot round, a tracer round, a black powder patch, or a black powder wad. The monomeric boron-nitrogen compound solution may be applied and adhered to the external surface 9 of the projectile 10, producing the coating 8. Once dried, the coating 8 may be substantially uniform and have a thickness of from approximately 0.05 mm to approximately 0.25 mm. For illustrative purposes, the thickness of the coating 8 is exaggerated in FIG. 1. In actuality, the coating 8 may provide a minimal change to the diameter of the projectile 10.

By way of non-limiting example, the coating 8 may be formed by dipping the projectile 10 into the monomeric boron-nitrogen compound solution and drying the coating 8. Alternatively, the coating 8 may be formed by placing a plurality of projectiles 10 in a rotatable tumbler, along with the monomeric boron-nitrogen compound solution. Hard media, such as ball bearings, plastic pellets, rice, wheat, rye, or barley, may also be placed in the rotatable tumbler to aid in adhering the coating 8 to the external surface 9. The rotatable tumbler may include, but is not limited to, a stand-alone cement mixer-size container or an augering device. The rotatable tumbler may be rotated for a sufficient amount of time and at a sufficient speed to form the coating 8 on the projectiles 10.

The ballistic weapon 6 may be a firearm or artillery capable of achieving, during use and operation, a temperature sufficient to polymerize the monomeric boron-nitrogen compound and form boron nitride. The ballistic weapon 6 may be a rifle, shotgun, handgun, machine gun, cannon, howitzer, recoilless rifle, or any other ballistic weapon capable of generating sufficient muzzle pressure and muzzle velocity when the projectile 10 is fired from the ballistic weapon 6. By way of non-limiting example, the muzzle pressure generated when the projectile 10 is fired may range from approximately 15,000 psi to approximately 65,000 psi. The muzzle velocity may range from approximately 700 ft/s to approximately 4200 ft/s, such as from approximately 2000 ft/s to approximately 5,000 ft/s. By way of non-limiting example, the ballistic weapon 6 may be an M16, an M4, a Lee-Enfield rifle, or other weapon capable of generating the sufficient pressure and muzzle velocity.

The coating 8 on the ballistic weapon 6 may partially cover or substantially cover an internal, metal surface of the ballistic weapon 6, the latter of which is illustrated in FIG. 2A. In one embodiment, the coating 8 is formed on the internal surface of a bore 12 of the ballistic weapon 6. The bore 12 may include cracks 14, as illustrated in FIG. 2B, which is an enlarged view of the indicated portion of FIG. 2A. The cracks 14 may include surface cracks, ladder cracks, or other microscopic surface defects. The bore 12 of the ballistic weapon 6 may be coated with the monomeric boron-nitrogen compound during the manufacture of the ballistic weapon 6. Alternatively, the coating 8 may be formed on the bore 12 in the field, such as during routine cleaning of the ballistic weapon 6. By way of non-limiting example, the monomeric boron-nitrogen compound may be incorporated into a conventional gun cleaning product. The monomeric boron-nitrogen compound may be soluble in, and compatible with, the components of the gun cleaning product. When the gun cleaning product is used to clean the ballistic weapon 6, the coating 8 may form on the bore 12. The coating 8 may be substantially uniform and have a thickness of less than or equal to approximately 0.1 mm, such as from approximately 0.05 mm to approximately 0.1 mm. The coating 8 may provide a minimal change to the inner diameter of the bore 12. While FIG. 2A illustrates the coated surface 4 of the ballistic weapon 6 as the bore 12, the coating 8 may be applied to other metal components of the ballistic weapon 6 including, but not limited to, the frame, chamber, barrel, bushing, slides, bolts, springs, screws, or levers.

When the projectile 10 is fired from the ballistic weapon 6, with either or both of the projectile 10 and ballistic weapon 6 including the coating 8, a sufficient temperature may be produced within the bore 12 of the ballistic weapon 6 to convert the monomeric boron-nitrogen compound to boron nitride. For the conversion to occur, the monomeric boron-nitrogen compound may be heated to a temperature of greater than approximately 100° C. as the projectile 10 is fired from the ballistic weapon 6. When the projectile 10 is fired from the ballistic weapon 6, the coating 8 on the projectile 10 or ballistic weapon 6 may provide a lower coefficient of friction than an uncoated projectile or uncoated ballistic weapon 6. Heat produced as a result of firing the projectile 10 may transfer from the projectile 10 and the ballistic weapon 6 to the monomeric boron-nitrogen compound causing polymerization of the monomeric boron-nitrogen compound to boron nitride. Since a projectile 10 fired from a ballistic weapon 6 may reach a temperature of up to approximately 1000° C., the monomeric boron-nitrogen compound may readily be subjected to a temperature of greater than approximately 100° C.

Figures 3A, 3B:
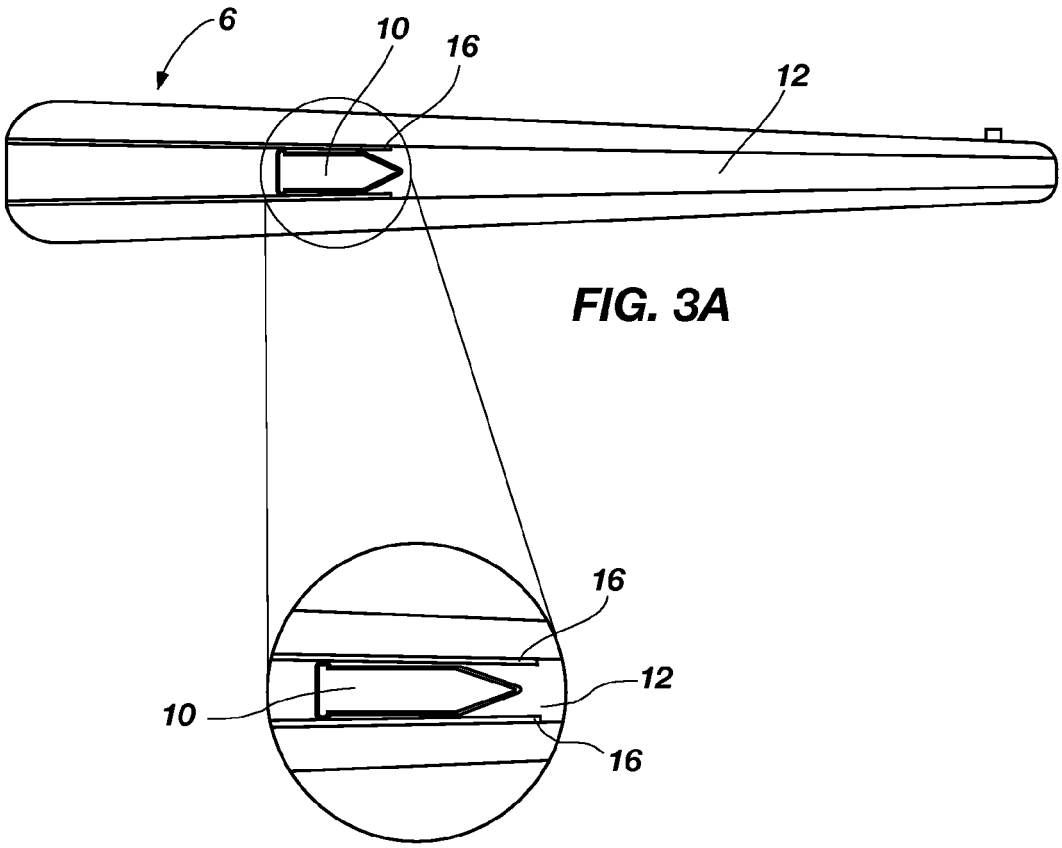
FIGS. 3A and 3B are cross-sectional views of a ballistic weapon coated with boron nitride according to an embodiment of the invention.

Firing of the projectile 10 from the ballistic weapon 6, with either or both of the projectile 10 and ballistic weapon 6 including the coating 8 of the monomeric boron-nitrogen compound, may form film 16 of the boron nitride on the internal surface of the bore 12, as illustrated in FIGS. 3A and 3B. The film 16 of boron nitride may deposit as the projectile 10 travels through and exits the bore 12. The passage of the projectile 10 through the bore 12 may generate a temperature sufficient to convert the monomeric boron-nitrogen compound to boron nitride and form the film 16. The film 16 may include a-BN, h-BN, r-BN, t-BN, w-BN, or combinations thereof. Over time and with repeated exposure to sufficient temperature, force, and pressure conditions, the a-, r-, t-, and w-forms of BN may convert to h-BN.

Depending on the number of firings to which the ballistic weapon 6 has been subjected, the film 16 may include a single form of BN or a combination of forms of BN. By way of non-limiting example, after a single firing of the ballistic weapon 6, the film 16 may include a-BN, r-BN, t-BN, w-BN, or a relatively small amount of h-BN. By way of non-limiting example, after a few firings of the ballistic weapon 6, the film 16 may include a-BN, r-BN, t-BN, w-BN, a relatively larger amount of h-BN, or combinations thereof. By way of non-limiting example, after repeated firings of the ballistic weapon 6, the film 16 may substantially include h-BN, with minor amounts of other forms of BN. The extent of the bore 12 covered by the film 16 may also depend on the number of firings to which the ballistic weapon 6 has been subjected. After a single firing of the ballistic weapon 6, the film 16 may form on at least a portion of the inner surface of the bore 12 of the ballistic weapon 6, as illustrated in FIGS. 3A and 3B. However, over time and after multiple firings, the film 16 may form on substantially all of the inner surface of the bore 12.

The film 16 may provide lubrication to the bore 12 and may prevent oxidation damage, such as corrosion, to the bore 12. The film 16 may also enable a reduced amount of residual material from the projectile 10, such as powder, primer, or projectile deposits, to remain in the bore 12 after each firing of the ballistic weapon 6. As such, the film 16 protects the bore 12 from abrasion when a subsequent projectile 10 is fired from the ballistic weapon 6. In addition, the film 16 may also reduce the frequency of cleaning the ballistic weapon 6. The film 16 may also partially or substantially fill the cracks 14 within the bore 12, healing the cracks 14, as illustrated in FIG. 3B, which is an enlarged view of the indicated portion of FIG. 3A. As such, the lifetime of the bore 12 is extended. The film 16 may also function as an insulating layer to reduce thermal shock and as a chemical barrier. By providing lubrication and preventing corrosion, the film 16 of boron nitride may lower the cost of operating the ballistic weapon 6, such as by extending its lifetime before a bore replacement is needed.

The monomeric boron-nitrogen compound may also be incorporated into a propellant or gun powder present in the projectile 10. When such a projectile 10 is fired from the ballistic weapon 6, the monomeric boron-nitrogen compound in the propellant or gun powder may be converted to boron nitride and may deposit as film 16 on the bore 12 of the ballistic weapon 6 in a manner similar to that previously described.

The monomeric boron-nitrogen compound may also be used to protect an inner surface of an internal combustion engine such as, without limitation, a piston bore, a piston, or piston rings. At least a portion of the inner surface of the internal combustion engine may be contacted with the monomeric boron-nitrogen compound. In use and operation, the process conditions produced by combustion of a fuel within the internal combustion engine may be sufficient to polymerize the monomeric boron-nitrogen compound into boron nitride. In a manner similar to that previously described, the boron nitride may deposit as a film on at least a portion of the inner surface of the internal combustion engine. By way of non-limiting example, the monomeric boron-nitrogen compound may be incorporated into a conventional fuel additive, which is poured into the internal combustion engine that contains the fuel. The monomeric boron-nitrogen compound may be at least partially soluble in the fuel additive. Alternatively, the monomeric boron-nitrogen compound may be added directly to the fuel present in the internal combustion engine. The monomeric boron-nitrogen compound may be at least partially soluble in the fuel. When the fuel is combusted, the temperature within the internal combustion engine may be sufficient to polymerize the monomeric boron-nitrogen compound and deposit the boron nitride as a film.

While the invention is susceptible to various modifications as well as alternative forms and implementations, specific embodiments have been shown in the drawings and have been described in detail herein. However, the scope of the invention is not limited to the particular embodiments disclosed. Rather, the invention, in various embodiments, encompasses all modifications, equivalents, and alternatives falling within the scope of the invention as defined by the following appended claims and their legal equivalents.

What is claimed is:

1. A method of forming a boron nitride coating comprising:

a. providing a monomeric boron-nitrogen compound;

b. providing a metal article comprising an internal surface;

c. positioning said provided monomeric boron-nitrogen compound within said internal surface of said metal article;

d. heating said monomeric boron-nitrogen to a substantially liquid state and to a temperature sufficient to convert at least part of said monomeric boron-nitrogen compound to boron nitride;

e. pressurizing said interior of said metal article, whereby said heated monomeric boron-nitrogen and said boron nitride coating at least part of said metal article and embedding into cracks and imperfections of said metal article; and f. cooling said metal article, thereby lubricating and healing said metal article with said boron nitride;

g. whereby said step of heating said monomeric boron-nitrogen and said step of pressuring said interior of said metal article is from the firing of a projectile from a ballistic weapon or combustion of fuel.

2. The method of claim 1 wherein:

a. the monomeric boron-nitrogen compound comprises at least one of: borazine, cycloborazane, trimethylcycloborazane, polyborazylene, B-vinylborazine, poly(B-vinylborazine) and derivatives thereof.

3. The method of claim 1 wherein:

a. the monomeric boron-nitrogen compound has a molecular size of greater than or equal to 10 angstroms.

4. The method of claim 1 wherein:

a. said boron nitride having an average particle size of less than 10 angstroms.

5. The method of claim 1 wherein:

a. said step of heating comprises generating a temperature in excess of 100° C. on said metal article and said monomeric boron-nitrogen compound.

6. The method of claim 1 wherein:

a. said metal article is the internal surface, bore, of a ballistic weapon capable of firing a projectile.

7. The method of claim 6 further comprising:

a. reducing the amount of at least one residual material deposited on said bore; and b. protecting said bore from abrasion when said projectile is fired from said ballistic weapon.

8. The method of claim 6 wherein:

a. said monomeric boron-nitrogen compound is incorporated into the propellant or gun powder in said projectile.

9. The method of claim 6 wherein:

a. said monomeric boron-nitrogen compound is applied and adhered to the external surface of said projectile.

10. The method of claim 6 wherein:

a. said monomeric boron-nitrogen compound is incorporated into a gun cleaning product; and b. said monomeric boron-nitrogen compound is deposited in a layer on the bore after cleaning with said gun cleaning product.

11. The method of claim 6 wherein:

a. said projectile is chosen from the group comprising: a bullet, a large artillery projectile, a shotgun shell, a shotgun wad, a bullet casing, and artillery shell, a rifle shell, a sabot round, a tracer round, a black powder patch, and a black powder wad.

12. The method of claim 1 wherein:

a. said metal article is the inner surface of an internal combustion engine.

13. The method of claim 12 wherein:

a. said inner surface is at least one of: a piston bore, a piston, or piston rings.

14. The method of claim 12 wherein:

a. said monomeric boron-nitrogen compound is incorporated into a fuel additive.

15. The method of claim 12 wherein:

a. said steps of heating said monomeric boron-nitrogen and pressurizing said interior of said metal article comprises combustion of a fuel within said internal combustion engine.

* * * * *